US006044531A

United States Patent [19]

Granell

[11] Patent Number: 6,044,531

[45] Date of Patent: Apr. 4, 2000

[54] SEAL FOR BAGS AND THE LIKE

[76] Inventor: Jaime Baucells Granell, Vich Street, 26-28, La Llagosta (Barcelona), Spain

[21] Appl. No.: 08/895,673

[22] Filed: Jul. 17, 1997

[30] Foreign Application Priority Data

Jul. 17, 1996 [ES] Spain ..... 9601958

[51] Int. Cl.[7] ..... A44B 21/00; B65D 33/00

[52] U.S. Cl. ..... 24/587; 24/400; 24/576

[58] Field of Search ..... 24/587, 400, 399, 24/381, 576; 383/63

[56] References Cited

U.S. PATENT DOCUMENTS

| | | | |
|---|---|---|---|
| 3,259,951 | 7/1966 | Zimmerman | 24/399 |
| 3,579,747 | 5/1971 | Hawley | 24/400 |
| 5,007,146 | 4/1991 | Meidan | 24/587 |
| 5,216,787 | 6/1993 | Custer et al. | 24/587 |
| 5,628,566 | 5/1997 | Schreiter | 24/587 |
| 5,655,273 | 8/1997 | Tomic et al. | 24/587 |
| 5,749,658 | 5/1998 | Kettner | 24/587 |

FOREIGN PATENT DOCUMENTS

| | | | |
|---|---|---|---|
| 1168794 | 12/1958 | France | 24/399 |

*Primary Examiner*—Victor N. Sakran

*Attorney, Agent, or Firm*—Mathews, Collins, Shepherd & Gould, P.A.

[57] ABSTRACT

Seal for bags and the like designed to carry out the attaching of the operating tongue of a zipper making up the fastening means of a bag or the like, the seal made up from a flattened channelled-shaped base body provided with undetachable fastening means for said bag or the like, said body having a narrowing associated to one of the ends of its mouthpiece, in a way such that this mouthpiece takes a shape matching with that of said tongue, which is being engageable to said mouthpiece, using the groove-tongue effect, allowing only a frontal engagement which is longitudinally locking both components. Also the spline of the base body has a higher depth than the tongue's thickness and incorporates some supports for said tongue; these supports defining a coplanar position between the tongue and the mouthpiece of the base body; in this position both components are lockable by means of a third part making up the seal and being concurrently engageable to the former ones (FIGS. 7 and 8).

5 Claims, 3 Drawing Sheets

SEAL FOR BAGS AND THE LIKE

OBJECT OF THE INVENTION

The present invention relates to a seal, particularly designed to ensure inviolability of bags, packets' fasteners or of any other similar components using as a fastener means, a zipper or any other similarly practicable and reuseable component.

BACKGROUND OF THE INVENTION

Indefinitely reusable bags, packets and any other similar components used for delivery of confidential documents or any other kind of objects requiring said confidentiality and using a zipper or the like as a fastening means, the zipper providing said reusable nature are already known.

To achieve delivery inviolability, seals conveniently attached to the bag or component being used, capable of receiving and attaching the zipper's tongue with an easily engageable snap fastener, which disengagement inescapably however brings about the seal breakage and proof of a tampered fastener are already known.

In this connection, the Spanish invention patent no. 421 407 discloses a seal made up in a base body, conveniently attached to the bag or component being used and provided with a prismatic protuberance closely going through a window. operatively made in the zipper's tongue, this protuberance being jutted out with respect to said tongue and incorporating a side window with access to its hollow inside, wherein the proper seal part itself made up with a kind of arrow tip, capable of penetration, by elastic strain, in the cavity of said small box is engageable, but is unable to be subsequently drawn out without breakage of the branches making up said arrow tip.

DESCRIPTION OF THE INVENTION

The seal proposed by the present invention has been designed and structured with the purpose to reduce the volume of the fastening component, particularly to achieve a better fastener flattening concurrently with a higher operating reliability, i.e. an improvement of the sealing effect.

For this purpose and more particularly, the seal advocated is structured from a base body attachable to the bag or component to be used, wherein a longitudinal spline with a narrowed mouthpiece at one of its ends is set up, such that said mouthpiece formally and dimensionally matches with the zipper's tongue; the zipper being retained by the steppings defined by said extreme narrowness.

Side undercuttings are made in the base body to seat the zipper's tongue such that the zipper becomes coplanar with the base body's mouthpiece and respective longitudinal slightly outphased and opposing bridges are set up in the tongue and in the base body's opposite faces, which when at the assembly position between both parts, respective axially opposing windows are defined, and for this purpose both the base part and the zipper's tongue are additionally having some undercuttings wherein the opposite part's bridges are engaged.

Between both parts, the base body and the zipper's tongue, the proper seal itself is designed to be engaged; this seal consisting of a thin rectangular and enlarged plate, topped at one of its ends by two spurs which are coplanar with this plate, which spurs after overrunning the windows defined by the previously cited bridges are locked to the base part; said proper seal itself making up a connecting link of the zipper's tongue with the base body, being thus prevented the disengagement of the first with respect to the second, while the drawing out of the proper seal itself is not caused; this drawing out not being possible to be carried out without these spurs being broken.

In accordance with other features of the invention, it has been provided the base body incorporated, at the exit of the window defined by its bridge, a prismatic-rectangular protuberance acting like a separating wedge between the two spurs of the proper seal itself to ensure therefore a full assurance of inviolability in the fastening means.

DESCRIPTION OF THE DRAWINGS

To complement the description herein and with the aim to help in the better understanding of the invention's features, the present illustrative specification, as an integral part of the invention, is accompanied with a set of drawings wherein an explanatory and non-exhaustive example of the invention has been shown as follows.

PREFERRED EMBODIMENT OF THE INVENTION

Figure 2:
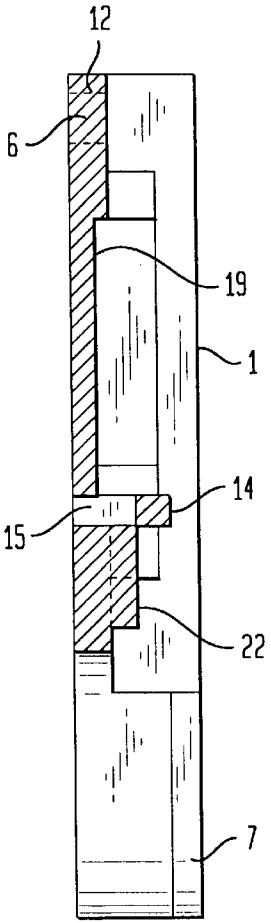
FIG. 2 shows a side elevation view and in a longitudinal and cross-sectional half of the base body shown in the previous figure, according to the cutting line A–B of said figure.
Figure 1:
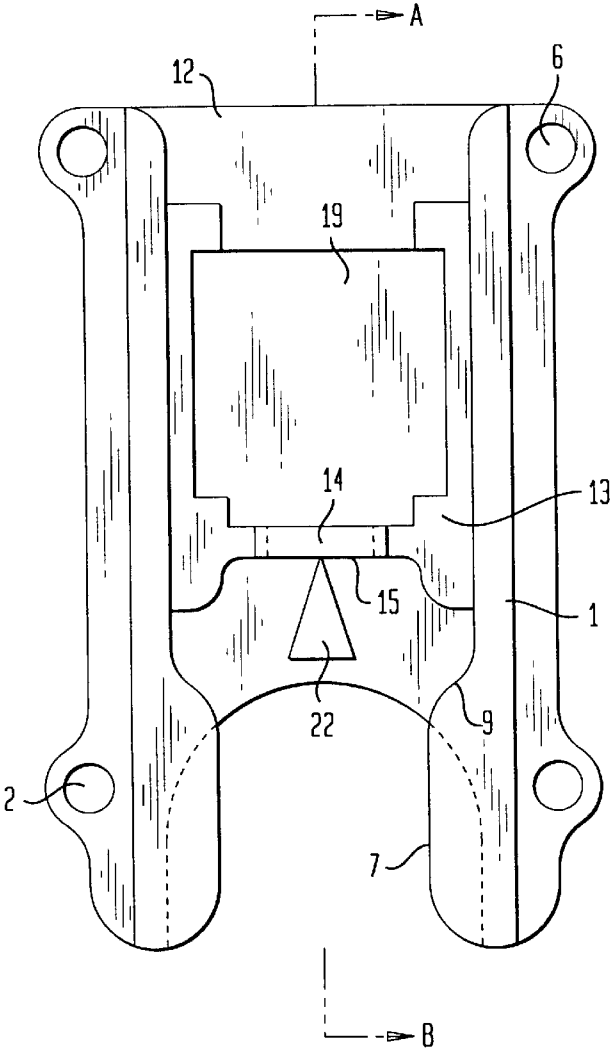
FIG. 1 shows a plan view of the base body taking part in the seal for bags and the like, object of the present invention.
Figure 3:
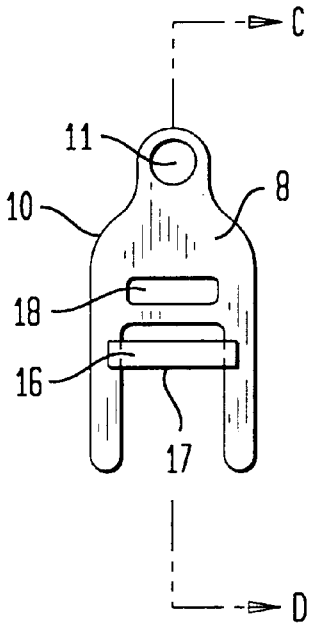
FIG. 3 shows a plan view of the zipper's tongue.
Figure 4:
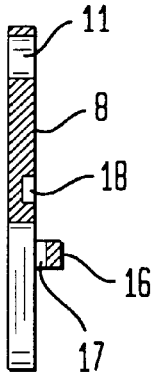
FIG. 4 shows a longitudinal cross-section of said tongue, according to the cutting line C–D of FIG. 3.

Returning to the figures it can be seen how the seal advocated for bags and the like is structured from a base body (1) remarkably flattened, equipped with side and pierced lugs (2) for its positioning to the wall of the bag (3) or in the component to be used, with the cooperation of an ancillary and internal plate (4) and rivets (5) or of any other conventional positioning means going through the holes (6) of these two parts with the special particularity the base body takes a channelled shape having at one of the ends of its mouthpiece, a narrowing (7) such that said mouthpiece is formally and dimensionally matching with the zipper's tongue (8). More definitely the stepped resettings (9) of the mouthpiece of the base part (1) coincide with the tongue (8) side steppings (10) in a way that after engaging said tongue into the mouthpiece of the base body (1), the mouthpiece remains locked opposite the longitudinal pullings exerted by the zipper's head. associated to its hole (11); the tongue (8) frontal disengagement relative to the base body (1) being required so that the zipper can suitably be handled.

The base body (1) depth, i.e. the bottom (12) of its spline is remarkably higher than the tongue (8) thickness, however marginal supports to seat said tongue (8) in a coplanar position with the base body's mouthpiece are suitable provided.

As a complement of the structure disclosed of the bottom (12) of the base body (1) and at a medium level, a determining bridge (14) of a transversally-elongated rectangular window (15) is jutting out, while from the tongue (8) lower face, another bridge(16) is jutting out determining in turn a window (17); these bridges (14) and (16) being arranged so that the engagement between both parts remain longitudinally and slightly outphased; its presence not. affecting however any appreciably rethicknening of the seal in the whole, because the bridge (14) of the base part (1) engages an overhung (18) of the tongue (8), while the bridge (16) of said tongue (8) in turn, engages an overhung (19) of the base body (1).

Figure 5:
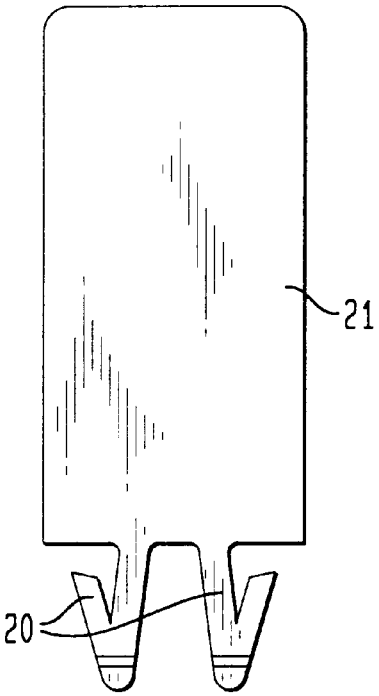
FIG. 5 shows a plan view of the third and last piece taking part in the seal, definitely the proper seal itself.
Figure 6:
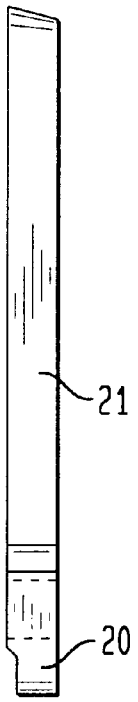
FIG. 6 shows in a side elevation view the part shown in the previous figure.
Figure 7:
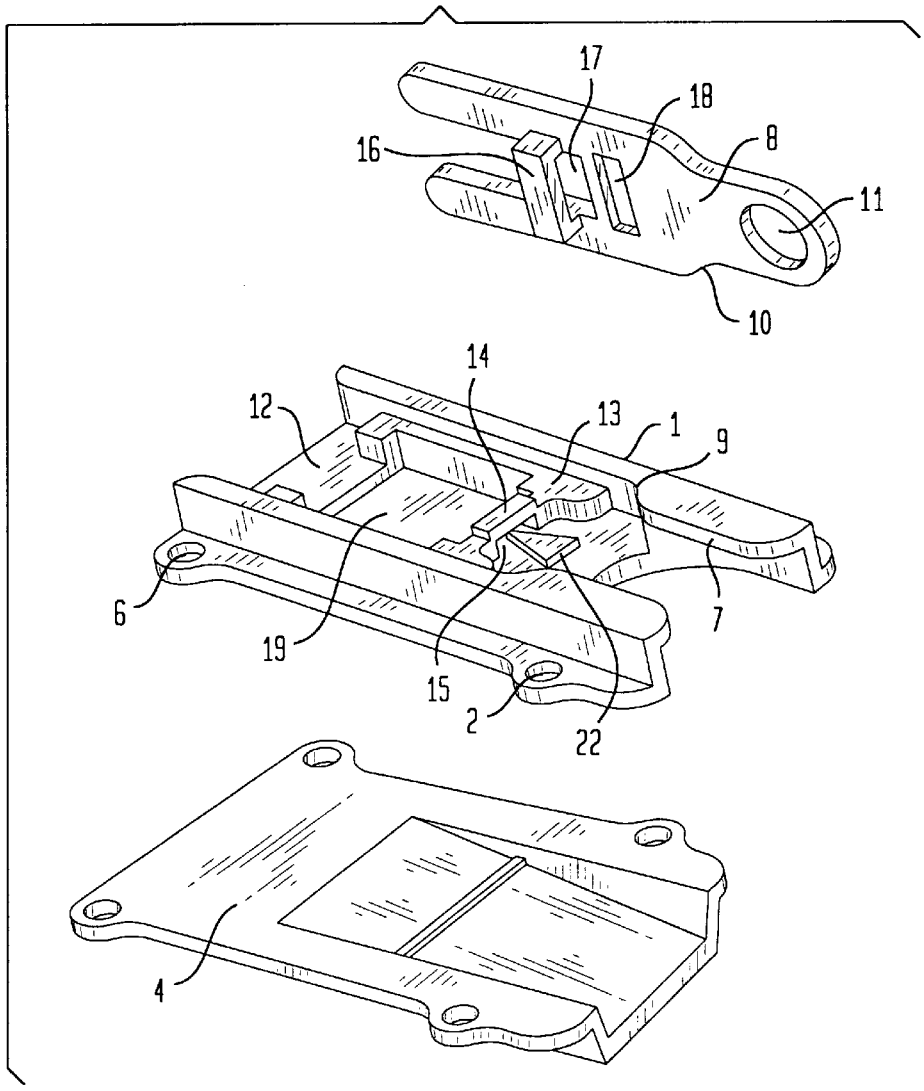
FIG. 7 shows a perspective exploded view of the seal in its whole.
Figure 8:
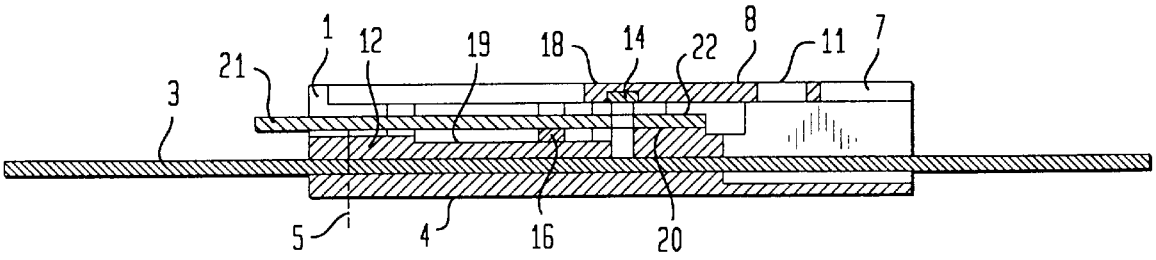
FIG. 8 shows finally the duly fitted assembly of the previous figure, in a fastening position and longitudinally cross-sectioned, according to the assembly's half and longitudinal plane.

In the assembly position, the windows (15) and (17) appear opposite such that through them two spurs (20) go through and a third part (21) topped thereto is taking part in the seal and makes up the proper seal itself; the seal taking then a laminar shape, as can be seen in FIGS. 5 and 6. Said spurs (20) overrun the bridge (14) of the base part (1) prior to an elastic strain of the spurs and its subsequent elastic retrieval determining the engagement of its free ends on the bridge (14) marginal areas, i.e. on the window (15) side areas. To this elastic retrieval is also further working together an isosceles-trapezoidally-shaped protuberance (22) which in the way of a wedge is incorporating the base body (1) to its spline (12) on its central shaft and immediately thereafter following the bridge (14), so that said wedge (22) urges the spurs (20) of the proper seal itself (21) to separate themselves during the proper engagement operation of said seal. All that prevents under any circumstances whatsoever, there is not any chance of strain in the spur (20), while in the inching direction a disengagement of the proper seal itself (21) is allowed without breaking the seal.

Finally it remains to bring forward that since the proper seal itself (21) makes up a frangible component in each system operation, a plurality of mutually integrated seals has been provided through weak links making up a continuous strip from which they are easily independent in a unit way.

The description is not necessarily thought to be more extensive so that any qualified specialist in the subject matter of the present invention may understand the same and its advantages derived therefrom.

Materials, shape, size and arrangement of the components are susceptible to variations, provided always all that is not involving any changes in the invention's essentiality.

Any terms used in the drafting of this specification have always to be taken only in their proper non-exhaustive wide sense.

I claim:

1. A seal of the type designed to carry out the attaching of the operating tongue of a zipper making up the reusable fastening means for a bag-like component, means for a bag-like component, the improvement comprising a flattened channeled-shaped base body provided with undetachable fastening means for said component; said body having a narrowing associated to one of the ends of its mouthpiece, in a way such this mouthpiece takes a formally and dimensionally shape matching with that of the zipper's tongue, which is being engageable to said mouthpiece using a groove-tongue effect allowing only a frontal engagement which longitudinally is locking both components and a spline depth of the base body being provided to be remarkably higher than the thickness of the zipper's tongue and in that said base body marginally and internally incorporates supports for said tongue, while defining a coplanar arrangement between the tongue and the mouthpiece of the base body; in this arrangement both components are lockable with the cooperation of a third part making up the proper seal itself and which comes out to be concurrently engageable to the former ones.

2. The seal according to claim 1, wherein the base body incorporates at a medium level, a bridge determining a rectangular, transversally-elongated window, while the zipper's tongue incorporates to what has to be its internal face, another similar bridge determining a second window, which in the assembly position, remains axially opposite to the former; both windows making pup the passing area for the third part forming the proper seal itself; this third part having at its frontal end, a pair of opposite spurs capable of going over the window of the base body, owing to the elastic strain of the spurs, making up after gong over said window, some locking means for the proper seal part itself, by helping in this way any subsequent drawing out without breaking said spurs.

3. The seal according to claim 1, wherein the base body incorporates immediately thereafter its transversal bridge and in a centered arrangement, a prismatic-triangular protuberance which like a wedge acts as a separating means for spurs of the proper seal plate itself, in the plate's engagement or penetration operation.

4. The seal according to claim 1, wherein the base body's bridge is engaged to an overhung of the zipper's tongue, while a bridge of the zipper is engaged in turn to an overhung at the bottom of the base body, so as a minimum thickness of the unit is achieved.

5. The seal according to claim 1, wherein the part making up the proper seal itself is a part of a continuous strip, wherein a plurality of parts are associated through easily frangible weak links for a unit independence of said parts or proper seals themselves.

* * * * *